US006294973B1

(12) United States Patent
Kimura et al.

(10) Patent No.: US 6,294,973 B1
(45) Date of Patent: Sep. 25, 2001

(54) IGNITION COIL FOR INTERNAL COMBUSTION ENGINE

(75) Inventors: Hiroshi Kimura; Rei Takada; Hidesato Horil, all of Hyogo (JP)

(73) Assignee: Hanshin Electric Co., Ltd., Kobe (JP)

( * ) Notice: Subject to any disclaimer, the term of this patent is extended or adjusted under 35 U.S.C. 154(b) by 0 days.

(21) Appl. No.: 09/534,320

(22) Filed: Mar. 24, 2000

(30) Foreign Application Priority Data

Apr. 2, 1999 (JP) ..... 11-096204

(51) Int. Cl.[7] ..... H01F 27/02
(52) U.S. Cl. ..... 336/96; 336/107
(58) Field of Search ..... 336/107, 110, 336/192, 198, 90, 222, 223, 96; 123/634, 635

(56) References Cited

U.S. PATENT DOCUMENTS 5,015,982 * 5/1991 Skinner et al. ..... 336/96
5,170,767 * 12/1992 Wada et al. ..... 123/633
5,349,320 * 9/1994 Suzuki et al. ..... 336/92
5,781,092 7/1998 Nakamichi et al. .

FOREIGN PATENT DOCUMENTS 43 09 818 9/1994 (DE) .
5221614 * 2/1977 (GB) .
2231729 * 5/1990 (GB) .
55-29105 * 3/1980 (JP) .
9-246070 9/1997 (JP) .

* cited by examiner

*Primary Examiner*—Lincoln Donovan
*Assistant Examiner*—Tuyen T. Nguyen
(74) *Attorney, Agent, or Firm*—Oblon, Spivak, McClelland, Maier & Neustadt, P.C.

(57) ABSTRACT

An ignition coil for an internal combustion engine includes a core-coil assembly that includes an endless outer ring core, a straight core intersecting the interior of the outer ring core to form a closed magnetic circuit in cooperation with the outer ring core, and a primary coil and a secondary coil concentrically fitted within the outer ring core and supported by the straight core piercing through the primary coil; and an insulation casing that has a bottom at which a high-voltage terminal connected electrically to an ignition plug is retained, supports and accommodates the core-coil assembly therein so that the core-coil assembly is orthogonal to the axis of the plug hole of the engine, and contains a solid layer of insulating resin cast-molded for fixing the core-coil assembly thereto. The secondary coil is ball-shaped and has coil turns that are largest in number at the equator of the ball and gradually decrease toward the opposite poles of the ball. The insulation casing has a lower portion funnel-shaped after the lower half of the ball for accommodating the lower half of the ball. The funnel-shaped lower portion of the insulation casing has a part accommodated within the plug hole when the insulation casing is mounted on the engine.

4 Claims, 3 Drawing Sheets

IGNITION COIL FOR INTERNAL COMBUSTION ENGINE

BACKGROUND OF THE INVENTION

1. Field of the Invention

The present invention relates to an ignition coil for an internal combustion engine, that is attached to an automobile engine, for example, for applying to an ignition plug provided at the bottom of a plug hole of the engine high voltage for causing the ignition plug to generate spark discharge.

2. Description of the Prior Art

JP-P-A HEI 9-246070, for example, discloses an ignition coil comprising a slender cylindrical main body inserted into a plug hole of an engine and having an open magnetic circuit core at its center, a primary coil and a secondary coil outside the core, an armoring core on its outer periphery and a high-voltage terminal at its tip; and an ignition plug provided at the bottom of the plug hole and having a top terminal that is directly connected to the high-voltage terminal to apply high voltage to the top terminal. In this prior art ignition coil, since the slender cylindrical main body is substantially entirely accommodated in the plug hole, the space required outside of the engine for installing the ignition coil is extremely small.

However, since an engine is generally made of aluminum alloy so as to minimize its weight and the open magnetic circuit core is disposed parallel to the axis of the plug hole, when an electric current is applied to the primary coil and the magnetic flux generated by the electric current flows through the core, an eddy current is generated in the aluminum portion surrounding the plug hole. This eddy current generates a magnetic flux that cancels the magnetic flux generated by the electric current to degrade the efficiency of the ignition coil.

There has recently been increasing demand for a high-output ignition coil for an internal combustion engine, that is applicable to a lean-burn engine or an alternative fuel engine. However, since the prior art ignition coil does not have good efficiency as described above, it does not meet this demand. In addition, since the plug hole for accommodating the ignition coil is inevitably restricted in size from the standpoint of the engine structure, it is difficult to secure sufficient insulation distance within the slender cylindrical main body of the ignition coil accommodated in such a size-restricted plug hole. Furthermore, since the temperature inside the plug hole is high owing to the heat from the engine, the ignition coil accommodated in the plug hole is exposed to a high temperature. Therefore, both the insulation distance and the high temperature should be taken into account in designing the ignition coil.

To eliminate these disadvantages, JP-UM Registration No. 3052284 proposes a molded ignition coil having a closed magnetic circuit as shown in FIG. 3, that comprises a high-voltage terminal 6 installed outside an engine, an ignition plug 40 attached to the bottom of a plug hole 31 of the engine, and a high-voltage relay joint 42 for electrically connecting the high-voltage terminal 6 and the ignition plug 40. In this prior art ignition coil, two E-shaped layer-built cores 3*a* and 3*b* constituting the closed magnetic circuit have their respective central legs 3' inserted into the interior of a bottomed insulation casing 4, one from a bottom side and the other from an open top side, so that the central legs 3' abut against each other and are joined together by means of an adhesive agent or welding or by other such means within the interior of the casing 4 and support therearound a cylindrical primary coil 1 and a cylindrical secondary coil 2 concentrically disposed. Opposite side legs 3" of the core 3*a* abut against and are joined to those 3" of the core 3*b*, respectively, in the same manner as the central legs 3', but outside the casing 4.

Further, the hole in the bottom 4' of the insulation casing 4, from which the central leg 3' of the core 3*a*, for example, is inserted, is stopped up by a bobbin for the primary coil 1; and the central leg 3' of the core 3*a* is thrust from the bottom side into the inner circumference of the primary coil bobbin. On the other hand, the central leg 3' of the core 3*b* is thrust from the open top side into the inner circumference of the primary coil bobbin and abuts against and is joined to the central leg 3' of the core 3*a* by means of an adhesive agent or the like means.

The prior art ignition coil is installed on the engine, and high voltage is applied from the ignition coil to the ignition plug 40 provided at the bottom of the plug hole 31. A rocker cover 33 provided with a cylindrical extension hole 32 communicating with the the upper opening of the plug hole 31 is laid over and fixed to the engine. The bottom 4' of the insulation casing 4 of the ignition coil is directed laterally so that the pair of E-shaped cores 3*a* and 3*b* with their respective legs joined together are orthogonal to the axis of the plug hole 31 and extension hole 32. In this state, the base portion 3 of one of the E-shaped cores 3*a* and 3*b* thrust out of the bottom 4' of the insulation casing 4 and the base portion 3 of the other of the E-shaped cores 3*a* and 3*b* thrust out of the open side of the casing 4 are attached by means of bolts etc. to a flange 35 protruding outwardly from a dish-shaped portion 34 integrally formed on the top of the cylindrical extension hole 32 of the rocker cover 33. A high-voltage cylindrical portion 7 integrally extending from the lateral side of the insulation casing 4 for supporting the high-voltage terminal 6 therein is directed downward and thrust into the interior of the extension hole 32 via the interior of the dish-shaped portion 34 of the rock cover 33.

An upper socket 43 of the high-voltage relay joint 42 covers the high-voltage cylindrical portion 7 and stops up the upper opening of extension hole 32, whereas a lower socket 44 of the high-voltage relay joint 42 covers the upper half of the ignition plug 40 provided at the bottom of the plug hole 31. A conductive member, such as a coil spring 45, retained within the high-voltage relay joint 42 in a piercing state electrically connects the high-voltage terminal 6 of the ignition coil and the top terminal 41 of the ignition plug.

One of the base portions 3 of the pair of opposed E-shaped cores 3*a* and 3*b* of the ignition plug protrudes outwardly from the bottom side of the insulation casing 4, and the other thereof protrudes outwardly from the open side of the insulation casing 4, that is stopped up by a solid layer 5 of insulating resin. When the insulation casing 4 is laid lateral to make the cores 3*a* and 3*b* orthogonal to the axis of the plug hole 31, the distance between the base portions 3 of the cores 3*a* and 3*b* becomes long. Since the base portions 3 are mounted on the flange 35 of the dish-shaped portion 34, the size of the dish-shaped cover 34 of the rocker cover 33 fixed outside the engine becomes correspondingly large. This requires a large space outside the engine for the installation of the dish-shaped cover 34.

One object of the present invention is to provide a small-sized ignition coil that does not require a large space outside an engine for the installation thereof and can suppress output decrease caused by occurrence of an undesirable magnetic flux.

SUMMARY OF THE INVENTION

To attain the above object, the present invention provides an ignition coil for an internal combustion engine, that comprises a core-coil assembly comprising an endless outer ring core, a straight core intersecting an interior of the outer ring core to form a closed magnetic circuit in cooperation with the outer ring core, and a primary coil and a secondary coil concentrically fitted within the outer ring core and supported by the straight core piercing through the primary coil; and an insulation casing having a bottom at which a high-voltage terminal connected electrically to an ignition plug is retained, supporting and accommodating the core-coil assembly therein so that the core-coil assembly is orthogonal to an axis of a plug hole of the internal combustion engine, and containing a solid layer of insulating resin cast-molded for fixing the core-coil assembly thereto; wherein the secondary coil is in the shape of a ball and has coil turns that are largest in number at an equator of the ball and gradually decrease toward opposite poles of the ball, the insulation casing has a lower portion funnel-shaped after a lower half of the ball for accommodating the lower half of the ball, and the funnel-shaped lower portion of the insulation casing has a part accommodated within the plug hole when the insulation casing is mounted on the internal combustion engine.

The outer ring core is formed to have an inner circumferential surface and an outer circumferential surface similar in shape to the ball and disposed so that the inner circumferential surface is in the vicinity of the equator of the ball.

The outer ring core is formed to have a width twice of which is smaller than a width of the straight core and a height larger than a height of the straight core so that the outer ring core has a cross-sectional area substantially the same as a cross-sectional area of the straight core.

In the ignition coil according to the present invention, as described above, the secondary coil is ball-shaped and has coil turns that are largest in number at the equator of the ball and gradually decrease toward the opposite poles of the ball, the insulation casing has a lower portion funnel-shaped after a lower half of the ball for accommodating the lower half of the ball, and the funnel-shaped lower portion of the insulation casing has a part accommodated within the plug hole when the insulation casing is mounted on the internal combustion engine. For this reason, the space required outside the engine for the installation of the ignition coil can be reduced to a great extent. In addition, since the outer ring core is formed to have an inner circumferential surface and an outer circumferential surface similar in shape to the ball, the outer ring core can be made smaller in size than a square-shaped one. Furthermore, since the outer ring core is formed to have a thickness twice of which is smaller than the width of the straight core, it can be further small-sized. Moreover, since the cores constituting the closed magnetic circuit are disposed in the direction orthogonal to the axis of the plug hole, the efficiency of the ignition coil will not be lowered.

The above and other objects, characteristic features and advantages will become apparent from the description to be made in detail with reference to the accompanying drawings.

BRIEF DESCRIPTION OF THE DRAWINGS

FIG. 1(*b*) is a cross section taken along line Ib—Ib in FIG. 1(*a*).

FIG. 1(*c*) is a cross section taken along line Ic—Ic in FIG. 1(*a*).

FIG. 3(*b*) is a cross section taken along line IIIb—IIIb in FIG. 3(*a*).

DESCRIPTION OF THE PREFERRED EMBODIMENT

Figure 1A:
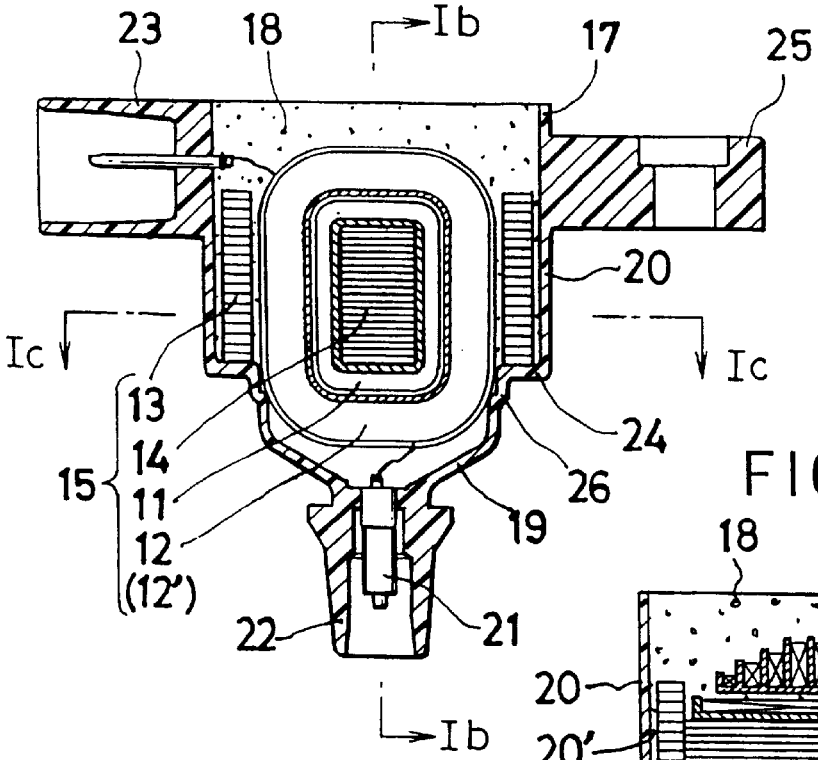
FIG. 1(*a*) is a longitudinal cross section showing one embodiment of the ignition coil according to the present invention.
Figure 1B:
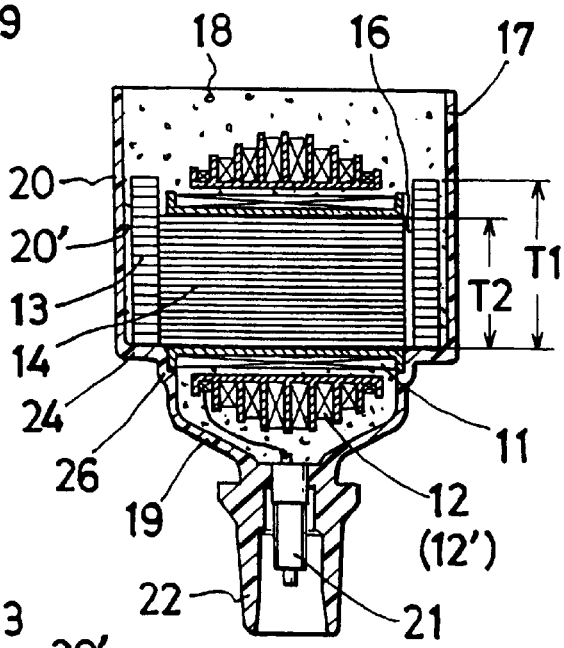
Figure 1C:
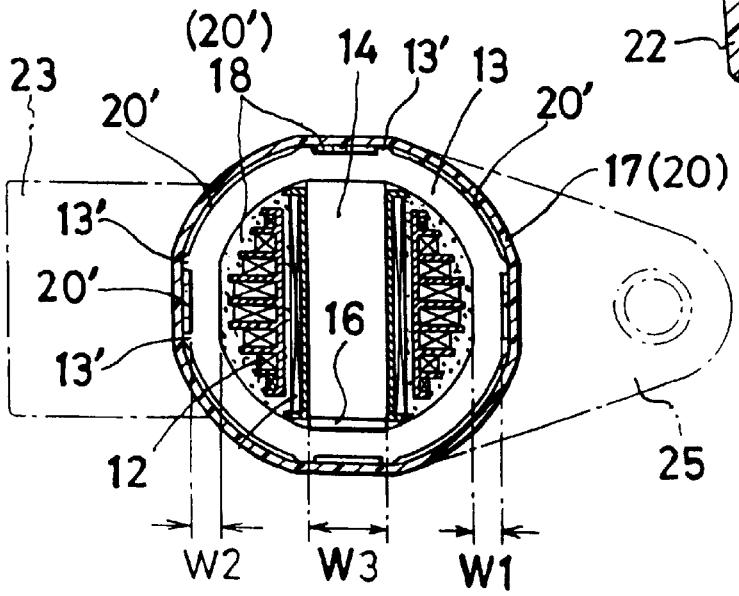
Figure 2:
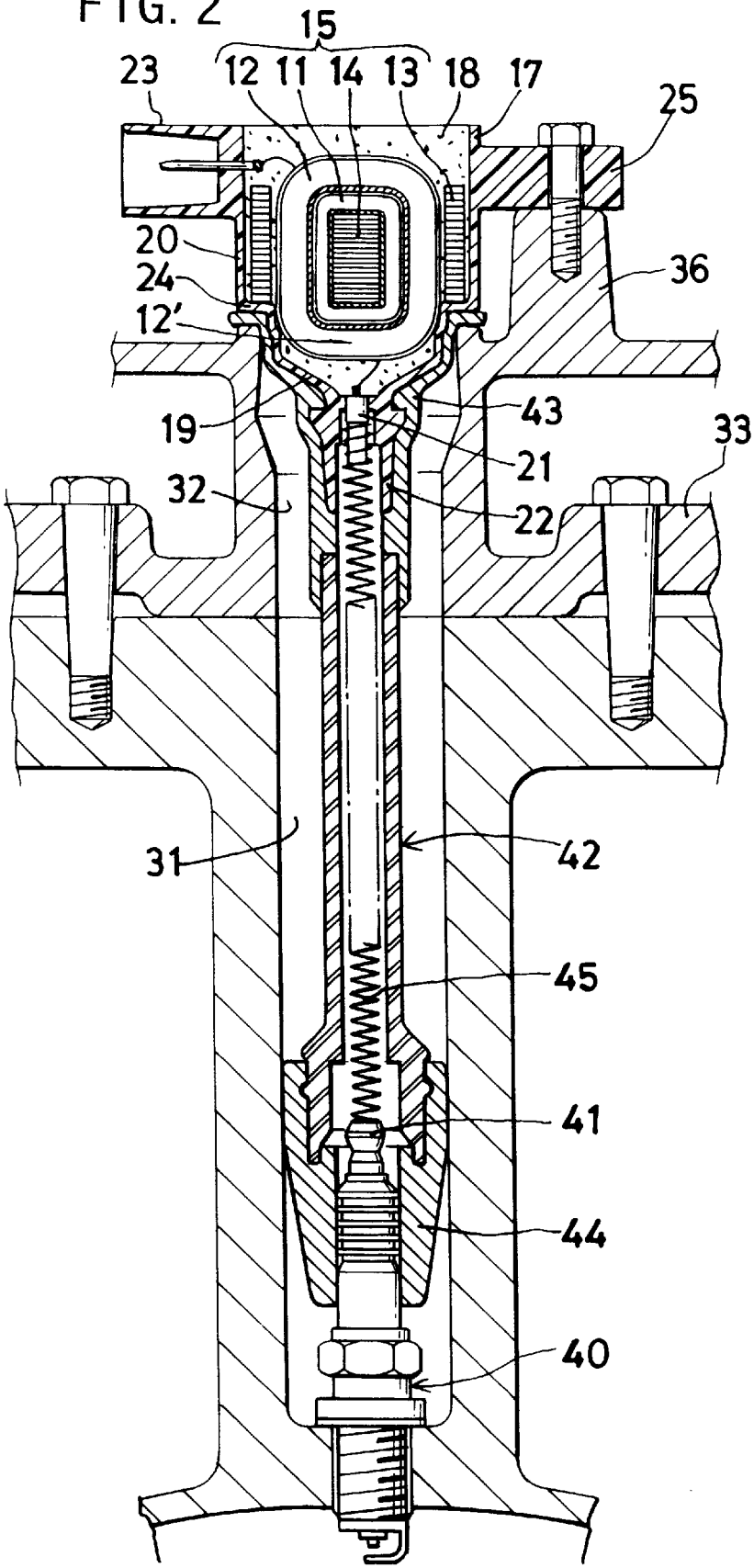
FIG. 2 is a cross section showing the ignition coil of FIG. 1(*a*) mounted on an engine.

FIGS. 1 and 2 illustrates one embodiment of the ignition plug according to the present invention, in which reference numeral 11 denotes a primary coil wound in the shape of a square pillar and numeral 12 designates a secondary coil wound concentrically with and outside of the primary coil 11. The secondary coil 12 is wound up between adjacent ones of a plurality of flanges arranged axially on the outer periphery of a bobbin so that the diameter of the secondary coil 12 is largest at the center in the axial direction of the bobbin and gradually decreases toward the opposite ends in the same axial direction. Therefore, the secondary coil 12 is formed into a ball such as a sphere or a Rugby ball. It goes without saying that the length of the center flanges is largest and those of the remaining flanges gradually decrease toward the opposite ends of the bobbin in the axial direction.

The size of the secondary coil 12 wound at the axial center of the bobbin, although varying depending on the size of the ignition coil and the diameter of the copper wire 12, is about 26 mm×about 32 mm, for example, and is made smaller gradually toward the opposite ends at which the size is about 18 mm×about 24 mm, for example. The number of coil turns between each adjacent pair of flanges is around 2,000 to 3,500 at the center and gradually decreases to around 250 to 800 toward the opposite ends.

Reference numerals 13 and 14 denote respectively an endless outer ring core and a straight core intersecting the interior of the outer ring core. The straight core 14 pierces through the inner circumference of a bobbin for the primary coil 11 and supports the primary and secondary coils 11 and 12 concentrically. The cores 13 and 14 and the coils 11 and 12 constitute a core-coil assembly 15 with a closed magnetic circuit.

Although there is no problem if each end of the straight core 14 and the inner circumference of the outer ring core 13 leave a gap therebetween, a thin permanent magnet 16 may be interposed between one end of the straight core 14 and the corresponding inner circumferential portion of the outer ring core 13. In this case, the magnetic poles of the surfaces of the thin permanent magnet 16 facing the one end of the straight core 14 and the corresponding inner circumferential portion of the outer ring core 13, respectively, are directed so that a magnetic flux produced from the thin permanent magnet 16 is opposite to a magnetic flux produced by applying an electric current to the primary coil 11. By thus disposing the permanent magnet at the one end of the straight core 14 in series relative to the closed magnetic circuit of the core-coil assembly 15, it is possible to apply a magnetic bias to the core-coil assembly 15, increase the amount by which the magnetic flux of the core-coil assembly 15 varies and heighten the output of the ignition coil.

The inner and outer circumferential surfaces of the outer ring core 13 are preferably similar in shape to the outside configuration of the secondary coil 12 and may be either spherical or polygonal. A plurality of pieces of different sizes having a circular or polygonal outside and inside configuration, each punched out of a silicon steel plate or formed by combining silicon steel plate segments with Ω-shaped projections and Ω-shaped recesses or by combining a substantially U-shaped silicon steel plate segment and a substantially I-shaped silicon steel plate segment, are layer-built into a spherical or polygonal outer ring core 13.

Denoted by reference numeral 17 is an insulation casing of synthetic resin for accommodating therein the core-coil assembly 15 with the cores 13 and 14 laid laterally and fixing thereto the core-coil assembly 15 with a layer 18 of insulating resin cast-molded and solidified inside the insulation casing 17. The insulation casing 17 comprises a lower portion 19 funnel-shaped after a lower spherical portion 12' of the secondary coil 12 projecting downward from the lower surfaces of the cores 13 and 14 for accommodating the lower spherical portion 12', and provided integrally with a high-voltage cylinder part 22 projecting downward from the outer bottom center of the funnel-shaped lower portion 19 for retaining therein a high-voltage terminal 21, and an upper cylindrical portion 20 integrally formed on the upper end of the funnel-shaped lower portion 19 for surrounding the outer ring core 13 and provided integrally with a primary socket 23 for a primary terminal, that projects outward from one side of the upper cylindrical portion 20. The funnel-shaped lower portion 19 can be thrust into a plug hole 31 of an engine or an extension hole 32 communicating with the plug hole 31.

The lower end of the upper cylindrical portion 20 integrally formed on the upper end of the funnel-shaped lower portion 19 is preferably provided with an endless support step 24 projecting inward for receiving the lower end of the outer ring core 13.

The ignition coil of the present invention is constituted by accommodating the core-coil assembly 15 inside the insulation casing 17, connecting the secondary coil 12 to the high-voltage terminal 21 and the primary coil 11 to the primary terminal of the primary socket 23, placing the lower end of the outer ring core 13 on the support step 24, cast-molding a solid layer 18 by charging an insulating resin, such as a thermosetting epoxy resin, in the insulation casing 17, thereby fixing the core-coil assembly 15 inside the insulation casing 17, and accommodating the lower spherical portion 12' of the secondary coil 12 within the funnel-shaped lower portion 19 of the insulation casing 17.

Figure 3A:
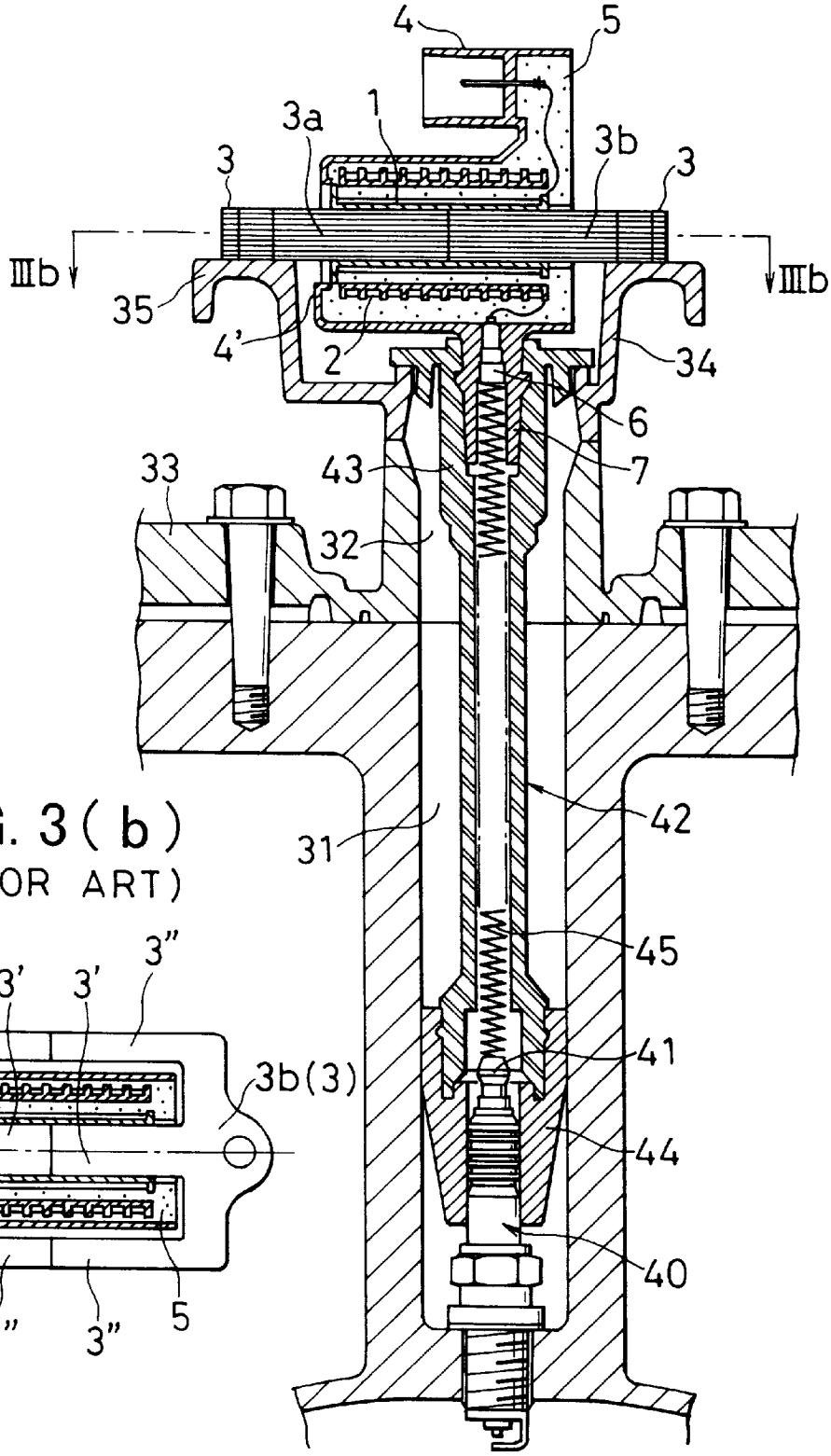
FIG. 3(a) (PRIOR ART)
FIG. 3(*a*) is a cross section showing a prior art ignition coil mounted on an engine.
Figure 3B:
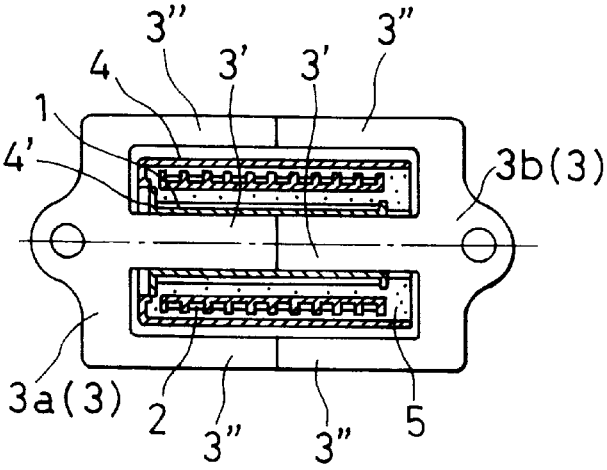
FIG. 3(b) (PRIOR ART)

High voltage is applied from the ignition coil thus constituted and mounted on an engine to an ignition plug 40 disposed at the bottom of the plug hole 31 of the engine by covering from below the funnel-shaped lower portion 19 of the insulation casing 17 including the high-voltage cylinder part 22 with an upper socket 43 of a high-voltage relay joint 42 advancing until the upper end of the upper socket 43 abuts against the support step 24 and electrically connecting the high-voltage terminal 21 of the ignition coil to a top terminal 41 of the ignition plug 40 using a conductive member 45, such as a coil spring (only the upper and lower sectioned shown), retained inside the high-voltage relay joint 42 in a piercing state (FIG. 2). In this instance, a flange 25 extending outward from one side of the upper cylindrical portion 20 of the insulation casing 17 is fixed to a support rod 36 rising from a rocker cover 33 by means of a bolt. Further, the portions in FIG. 2 corresponding to those in FIG. 3 are given the same reference numerals, and the detailed description of the portions in FIG. 2 have been omitted.

By thus mounting the ignition coil on the engine, the funnel-shaped lower portion 19 of the insulation casing 17 accommodating therein the lower spherical portion 12' of the secondary coil 12 projecting from the cores 13 and 14 is thrust into the plug hole 31 or upward communicating extension hole 32. Therefore, the space required outside the engine for installing the ignition coil can be made small.

The outer ring core 13 has its inner and outer circumferential surfaces formed each into a ball, such as a sphere or a Rugby ball, similar in shape to the configuration of the secondary coil 12 and its inner circumferential surface disposed in the vicinity of the equator of the secondary coil 12.

The outer ring core 13 is provided on its outer circumferential surface with a plurality of ribs 13' disposed at intervals in the circumferential direction for abutting against on the inner circumferential surface of the upper cylindrical portion 20 of the insulation casing 17. This is advantageous because gaps 20' can be left between the outer circumferential surface of the outer ring core 13 and the inner circumferential surface of the upper cylindrical portion 20 for use in solidifying excess amount of the insulating resin entering the gaps when cast-molding the insulating resin.

In FIG. 1(*c*), the sum of widths $W_1$ and $W_2$ (twice the thickness) of the outer ring core 13 is set smaller than the width $W_3$ of the straight core 14, thereby enabling the diameter or configuration of the outer ring core to be smaller and consequently the diameter of the upper cylindrical portion 20 of the insulation casing 17 to be smaller. As a result, the ignition coil can be made small-sized and light-weight and the space required outside the engine for installing the ignition coil can be made small. However, when the sum of the widths $W_1$ and $W_2$ of the outer ring core 13 is set smaller than the width $W_3$ of the straight core 14 as described above, the longitudinal cross-sectional area of the outer ring core 13 is smaller than that of the straight core 14. This raises the possibility of adversely affecting the magnetic flux that flows through the closed magnetic circuit constituted of the cores 13 and 14 and lowering the output of the ignition coil. To avoid this, the thickness $T_1$ (height) of the outer ring core 13 may be set larger than the thickness $T_2$ (height) of the straight core 14, as shown in FIG. 1(*b*), so that the longitudinal cross-sectional area of the outer ring core 13 becomes substantially the same as that of the straight core 14.

The axial opposite ends of the primary coil 11 through which the straight core 14 pierces slightly project outward from the axial opposite ends of the secondary coil 12 fitted outside the primary coil 11. The funnel-shaped lower portion 19 of the insulation casing 17 is provided on the inner circumferential surface at the upper end thereof with two support steps 26 opposed in the diametrical direction for supporting the opposite ends of the flange of the bobbin for the primary coil 11. The support steps 26 may be formed into an annular support step.

Since the straight core 14 intersects the interior of the outer ring core 13 and is fixed to the inner circumferential surface of the outer ring core 13, the support steps 24 and 26 function to infallibly retain the core-coil assembly 15 inside the insulation casing 17 until the insulating resin cast-molded inside the insulation casing 17 in which the core-coil assembly 15 has been accommodated has solidified. One of the support steps 24 and 26 can be omitted because the outer ring core 13 and straight core 14 are integrally fixed to each other.

As has been described in the foregoing, in the ignition coil according to the present invention, the secondary coil is given the shape of a ball, such as a sphere or a Rugby ball, so that the number of turns of coil is largest at the axial center thereof and gradually reduces toward the axial opposite ends thereof, and the insulation casing has a lower portion funnel-shaped after the lower half of the secondary coil configuration for accommodating the lower half of the secondary coil and provided with a part that can be accommodated in a plug hole of an engine when the insulation housing is mounted on the engine. This structure enables the space required outside the engine for installing the ignition coil to be small and the engine compartment to be small-sized.

Furthermore, since the outer ring core of the ignition coil according to the present invention has its inner and outer circumferential surfaces similar in shape to the configuration of the secondary coil, the ignition coil can be made small-sized and lightweight. Moreover, since the cores constituting the closed magnetic circuit of the ignition coil according to the present invention are disposed orthogonal to the axis of the plug hole of the engine, the output of the ignition coil is not lowered.

What is claimed is:

1. An ignition coil for applying high voltage to an ignition plug provided at a bottom of a plug hole in an internal combustion engine, comprising:

a core-coil assembly comprising an outer ring core, a straight core intersecting an interior of said outer ring core to form a closed magnetic circuit in cooperation with said outer ring core, and a primary coil and a secondary coil concentrically fitted within said outer ring core and supported by said straight core piercing through said primary coil; and an insulation casing having a bottom at which a high-voltage terminal connected electrically to the ignition plug is retained, said insulation casing being configured to support and accommodate said core-coil assembly therein so that said core-coil assembly is orthogonal to an axis of the plug hole of the internal combustion engine, and configured to contain a solid layer of insulating resin cast-molded so as to fix said core-coil assembly thereto;

wherein said secondary coil is substantially in the shape of a ball and has coil turns that are largest in number at an equator of said ball and gradually decrease toward an upper and a lower half of said ball, said insulation casing has a funnel-shaped lower portion after the lower half of said ball that is configured to accommodate the lower half of said ball, and said funnel-shaped lower portion of said insulation casing is accommodated within at least the plug hole and an extension hole, configured to communicate with the plug hole, when said insulation casing is mounted on the internal combustion engine.

2. The ignition coil according to claim 1, wherein said outer ring core is formed to have an inner circumferential surface and an outer circumferential surface similar in shape to said ball and disposed so that the inner circumferential surface is in the vicinity of the equator of said ball.

3. The ignition coil according to claim 1, wherein said outer ring core is formed to have a first width smaller than a second width of said straight core and a first height larger than a second height of said straight core so that said outer ring core has a cross-sectional area substantially the same as a cross-sectional area of said straight core.

4. The ignition coil according to claim 2, wherein said outer ring core is formed to have a first width smaller than a second width of said straight core and a first height larger than a second height of said straight core so that said outer ring core has a cross-sectional area substantially the same as a cross-sectional area of said straight core.

* * * * *

UNITED STATES PATENT AND TRADEMARK OFFICE

CERTIFICATE OF CORRECTION

PATENT NO. : 6,294,973 B1
DATED : September 25, 2001
INVENTOR(S) : Kimura et al.

It is certified that error appears in the above-identified patent and that said Letters Patent is hereby corrected as shown below:

Title page,
Item [75], the Inventors' names should read:
-- [75] Inventors: Hiroshi Kimura; Rei Takada;
Hidesato Horii, all of Hyogo (JP) --

Signed and Sealed this

Twenty-eighth Day of May, 2002

*Attest:*

*Attesting Officer*

JAMES E. ROGAN
*Director of the United States Patent and Trademark Office*